United States Patent [19]

Guertin

[11] Patent Number: 4,497,350

[45] Date of Patent: Feb. 5, 1985

[54] VAPOR RECOVERY SYSTEM HAVING AUTOMATIC SHUT-OFF MECHANISM

[75] Inventor: Robert W. Guertin, Cincinnati, Ohio

[73] Assignee: Dover Corporation, New York, N.Y.

[21] Appl. No.: 506,857

[22] Filed: Jun. 22, 1983

[51] Int. Cl.[3] ..... B65B 3/18

[52] U.S. Cl. ..... 141/206; 141/198; 141/217; 141/225; 141/392

[58] Field of Search ..... 141/192, 198, 206-229, 141/392

[56] References Cited

U.S. PATENT DOCUMENTS

| | | | |
|---|---|---|---|
| 2,582,195 | 1/1952 | Duerr | 141/209 |
| 3,077,212 | 2/1963 | Hearn | 141/209 |
| 3,085,600 | 4/1963 | Briede | 141/209 |
| 3,603,359 | 9/1971 | Belue | 141/208 |
| 3,771,577 | 11/1973 | Mayer | 141/209 |
| 3,835,899 | 9/1974 | Holder, Jr. | 141/214 |
| 3,974,865 | 8/1976 | Fenton et al. | 141/226 X |
| 4,131,140 | 12/1978 | Deters | 141/206 |
| 4,141,393 | 2/1979 | Mayer | 141/206 |
| 4,286,635 | 9/1981 | McMath | 141/208 X |

*Primary Examiner*—John W. Shepperd
*Assistant Examiner*—Ernest G. Cusick
*Attorney, Agent, or Firm*—Kinney and Schenk

[57] ABSTRACT

Flow through a vapor recovery nozzle is stopped when the liquid in a tank being filled reaches a predetermined level to cause a first diaphragm, which forms a wall of a first chamber, to move a latch release mechanism against the force of a single spring. Flow through the nozzle also is stopped when pressure in the tank being filled exceeds a predetermined pressure through movement of a second diaphragm, which is disposed in a plane substantially perpendicular to the plane of the first diaphragm and forms a wall of a second chamber connected by two separate passages to a vapor return passage communicating the tank with vapor recovery equipment, to cause movement of the latch release mechanism in the same direction and against the force of the same spring. The first diaphragm is prevented from moving in response to the pressure in the tank increasing. The exterior of each of the first and second diaphragms is exposed to ambient pressure.

20 Claims, 17 Drawing Figures

FIG-8
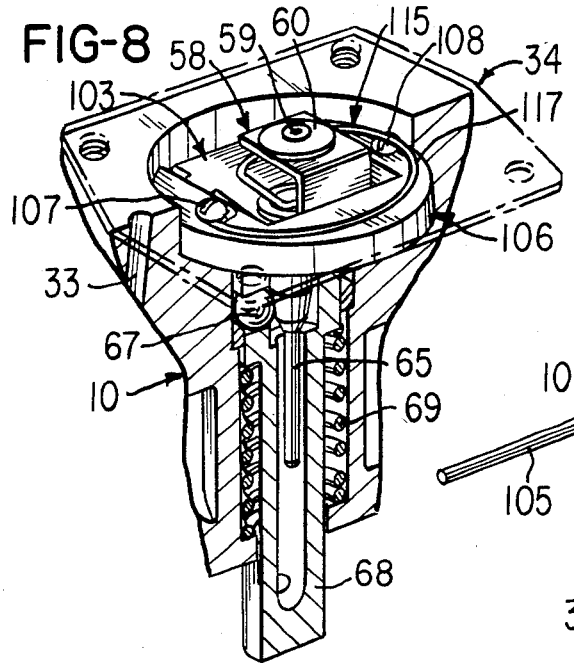
FIG-9
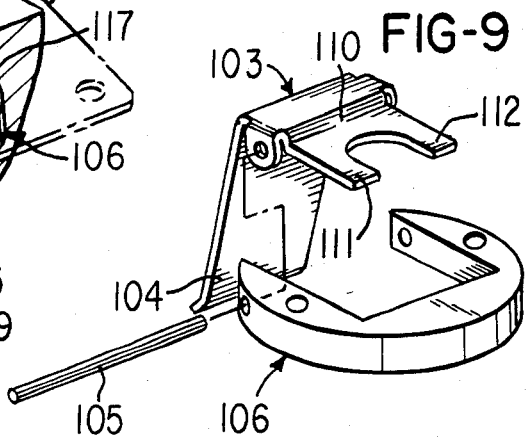
FIG-10
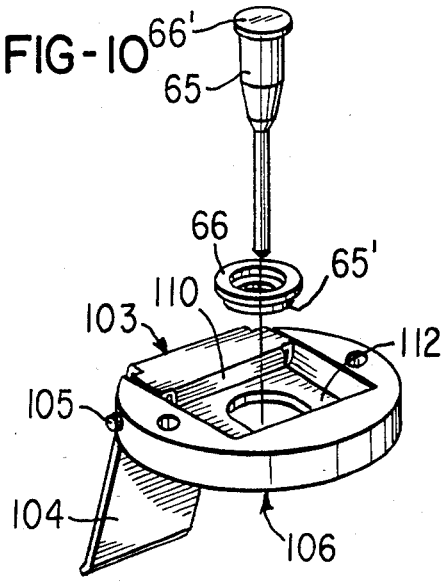
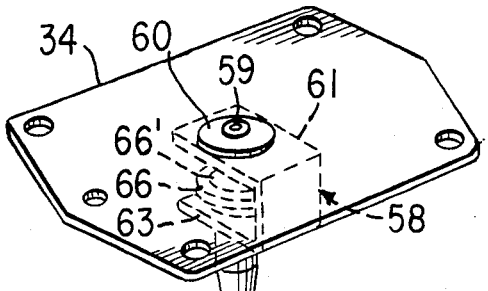
FIG-11
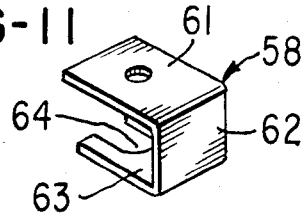
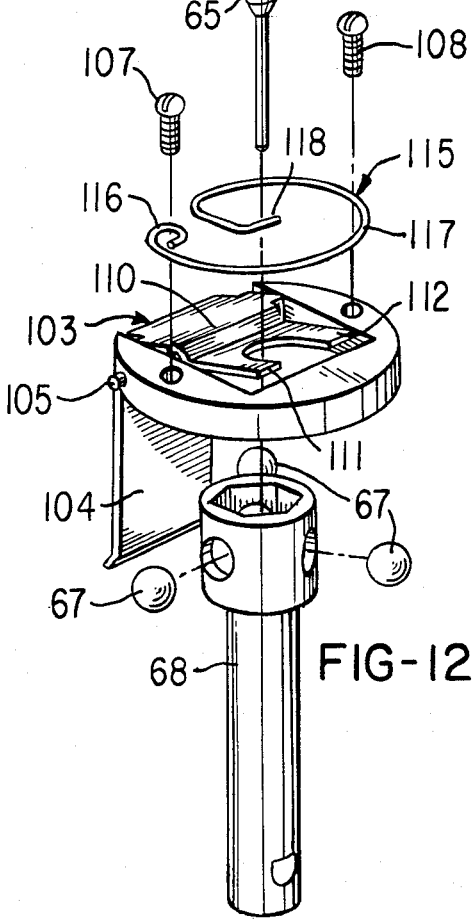
FIG-12

FIG-14
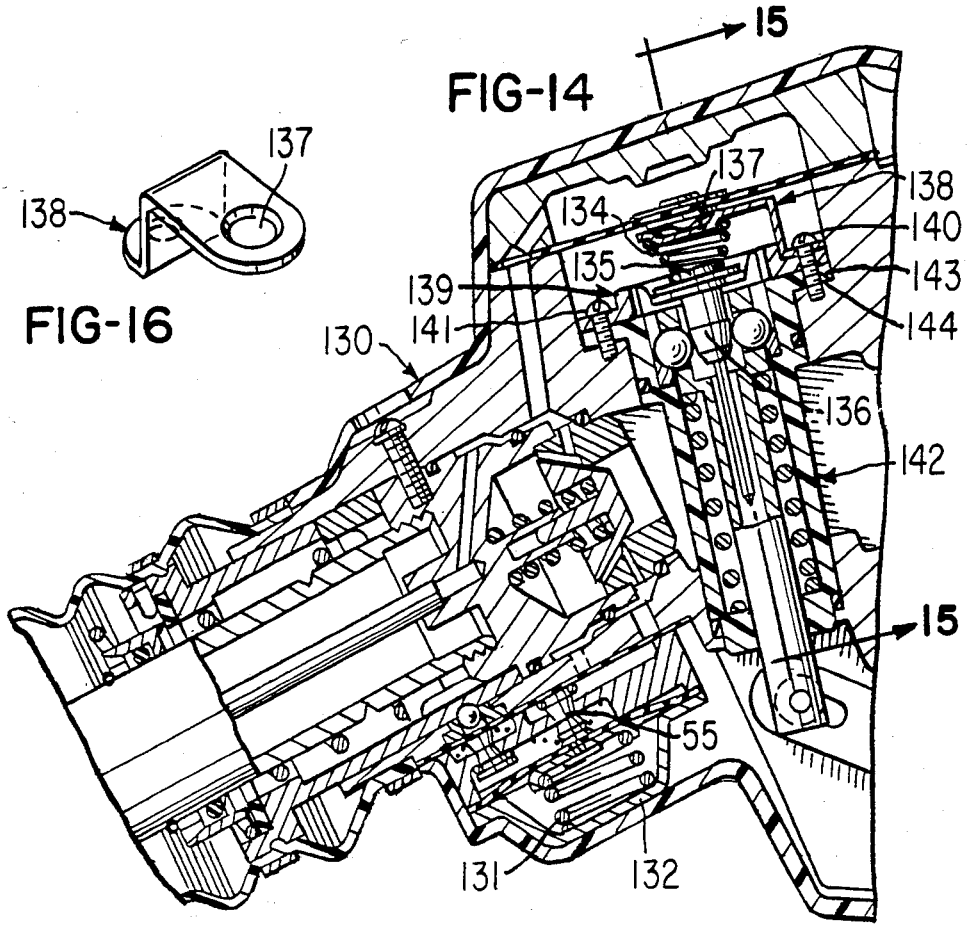
FIG-16
FIG-15
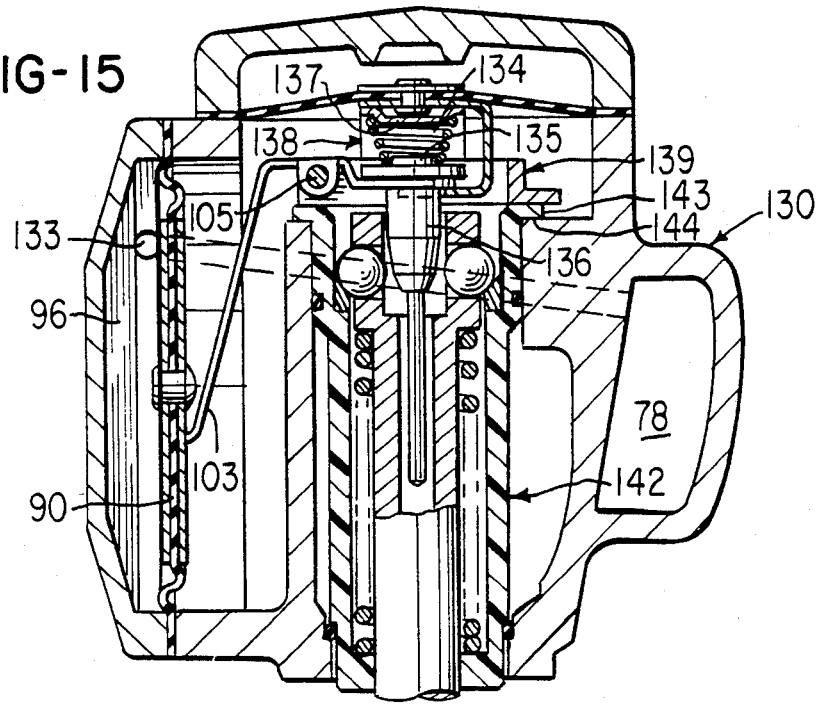

VAPOR RECOVERY SYSTEM HAVING AUTOMATIC SHUT-OFF MECHANISM

This invention relates to a vapor recovery nozzle having an automatic shut-off mechanism responsive to the liquid reaching a predetermined level in a tank being filled or the pressure in the tank being filled exceeding a predetermined pressure and, more particulary, to a vapor recovery nozzle having an automatic shut-off mechanism with two separate diaphragms responsive to the two different conditions.

Various types of vapor recovery nozzles having one or two diaphragms to stop flow through the nozzle when the liquid in the tank being filled reaches a predetermined level or the pressure in the tank exceeds a predetermined pressure are shown and described in U.S. Pat. No. 3,811,486 to Wood, U.S. Pat. No. 3,823,752 to Lasater et al, U.S. Pat. No. 3,835,899 to Holder, Jr., and U.S. Pat. No. 3,974,865 to Fenton et al.

The aforesaid Fenton et al patent has a vapor recovery nozzle through which flow is automatically stopped in response to the liquid in the tank being filled reaching a predetermined level or the pressure in the tank exceeding a predetermined pressure. The vapor recovery nozzle of the aforesaid Fenton et al patent includes a pair of diaphragms disposed in planes substantially parallel to each other with a first diaphragm, which is responsive to the liquid in the tank reaching the predetermined level, being connected to a U-shaped bracket having a pair of elongated slots through which a pair of latching rollers extends. The second diaphragm, which is responsive to the pressure in the tank exceeding the predetermined pressure, has a U-shaped bracket connected thereto for receiving the pair of latching rollers in a recess in the end of each of its pair of arms.

The movement of each of the diaphragms to move the rollers out of their latching position in a recess in a slide member is in the same direction. However, it is necessary to have the first diaphragm, which has one side responding to the liquid level in the tank, have its other side exposed to the pressure in the tank. Otherwise, the pressure from the tank, which also acts on the one side of the first diaphragm, would move the bracket connected to the first diaphragm in the direction in which it would hold the rollers in their latching position while the second diaphragm would want to move the rollers in the opposite direction when the pressure in the tank exceeded the predetermined pressure. Because the rollers are captured in the elongated slots in the U-shaped bracket attached to the first diaphragm, the pressure acting on the first diaphragm would prevent the latching rollers from being moved out of the recess in the slide member.

To avoid this, the first diaphragm of the aforesaid Fenton et al patent has its other side exposed to an area having the pressure in the vapor recovery passage and through which the slide member moves. This requires a very tight sealing arrangement of the area to prevent leakage of vapors therefrom and to maintain the area sealed.

This also requires a special flow path arrangement to communicate with the chamber having the second diaphragm forming a wall thereof. Therefore, the vapor recovery nozzle of the aforesaid Fenton et al patent requires a relatively expensive flow path arrangement and a relatively expensive sealing arrangement.

The vapor recovery nozzle of the present invention overcomes the disadvantages of the vapor recovery nozzle of the aforesaid Fenton et al patent in that there is no requirement for a first diaphragm, which is movable in response to the liquid in the tank reaching a predetermined level to create a partial vacuum acting on one surface of the first diaphragm, to have the pressure in its vapor return passage means acting on its opposite surface. Thus, the first diaphragm, which forms a wall of a first chamber, can have its opposite or exterior surface subjected to ambient pressure to eliminate the sealing arrangement required in the aforesaid Fenton et al patent.

The vapor recovery nozzle of the present invention also is able to have a pair of passages communicating separate portions of a second chamber, which has a second diaphragm responsive to the pressure in the tank forming a wall thereof, with the vapor return passage means. These two passages avoid the difficulty of liquid being trapped within the second chamber as can occur with a single passage when liquid inadvertently enters the vapor return passage means. If the liquid is trapped in the second chamber, the valve cannot be moved to its open position.

The vapor recovery nozzle of the present invention uses a pair of diaphragms disposed in planes substantially perpendicular to each other for response to the liquid in the tank reaching a predetermined level or the pressure in the tank exceeding a predetermined pressure. The vapor recovery nozzle of the present invention requires only a single spring acting in the same direction as the release mechanism moves to return each of the diaphragms to its initial or at rest position and the latch release mechanism to its at rest or latched position in which the valve may be opened by manually operated means.

The vapor recovery nozzle of the present invention also includes means to prevent the first diaphragm, which causes liquid flow through the nozzle body to stop when the liquid in the tank reaches the predetermined level, from moving in response to the pressure in the tank exceeding the predetermined pressure since the first diaphragm is exposed to the pressure in the tank as long as the liquid in the tank does not reach the predetermined level.

An object of this invention is to provide a vapor recovery nozzle having automatic shut off in response to the pressure in the tank being filled exceeding a predetermined pressure or the liquid in the tank reaching a predetermined level through two separate diaphragms.

Another object of this invention is to provide a vapor recovery nozzle having automatic shut off in response to the pressure in the tank being filled exceeding a predetermined pressure or the liquid in the tank reaching predetermined level in which the diaphragms are not connected to each other.

A further object of this invention is to provide a vapor recovery nozzle having automatic shut off in response to the pressure in the tank being filled exceeding a predetermined pressure or the liquid in the tank reaching a predetermined level with a pair of uniquely arranged diaphragms causing the automatic shut off.

Other objects, uses, and advantages of this invention are apparent upon a reading of this description, which proceeds with reference to the drawings forming part thereof and wherein:

FIG. 8 is a fragmentary perspective view of a portion of the nozzle body of FIG. 3 and taken 180° from the position shown in FIG. 3.

FIG. 9 is an exploded perspective view of some of the elements responsive to the pressure in the tank being filled.

FIG. 10 is an exploded perspective view showing the structure of FIG. 9 assembled and latch retaining pin and a washer for cooperation therewith.

FIG. 11 is perspective view of a yoke utilized with the latch retaining pin of FIG. 10.

FIG. 12 is an exploded perspective view showing various elements of the automatic shut-off mechanism including the elements of FIGS. 9, 10 and 11.

FIG. 14 is a fragmentary sectional view of a portion of another embodiment of a nozzle having the shut-off mechanism of the present invention incorporated therein.

FIG. 15 is a fragmentary sectional view of a portion of the nozzle body of the nozzle of FIG. 14 and taken substantially along line 15—15 of FIG. 14.

FIG. 16 is a perspective view of a spring retainer of the nozzle of FIGS. 14 and 15.

Figure 1:
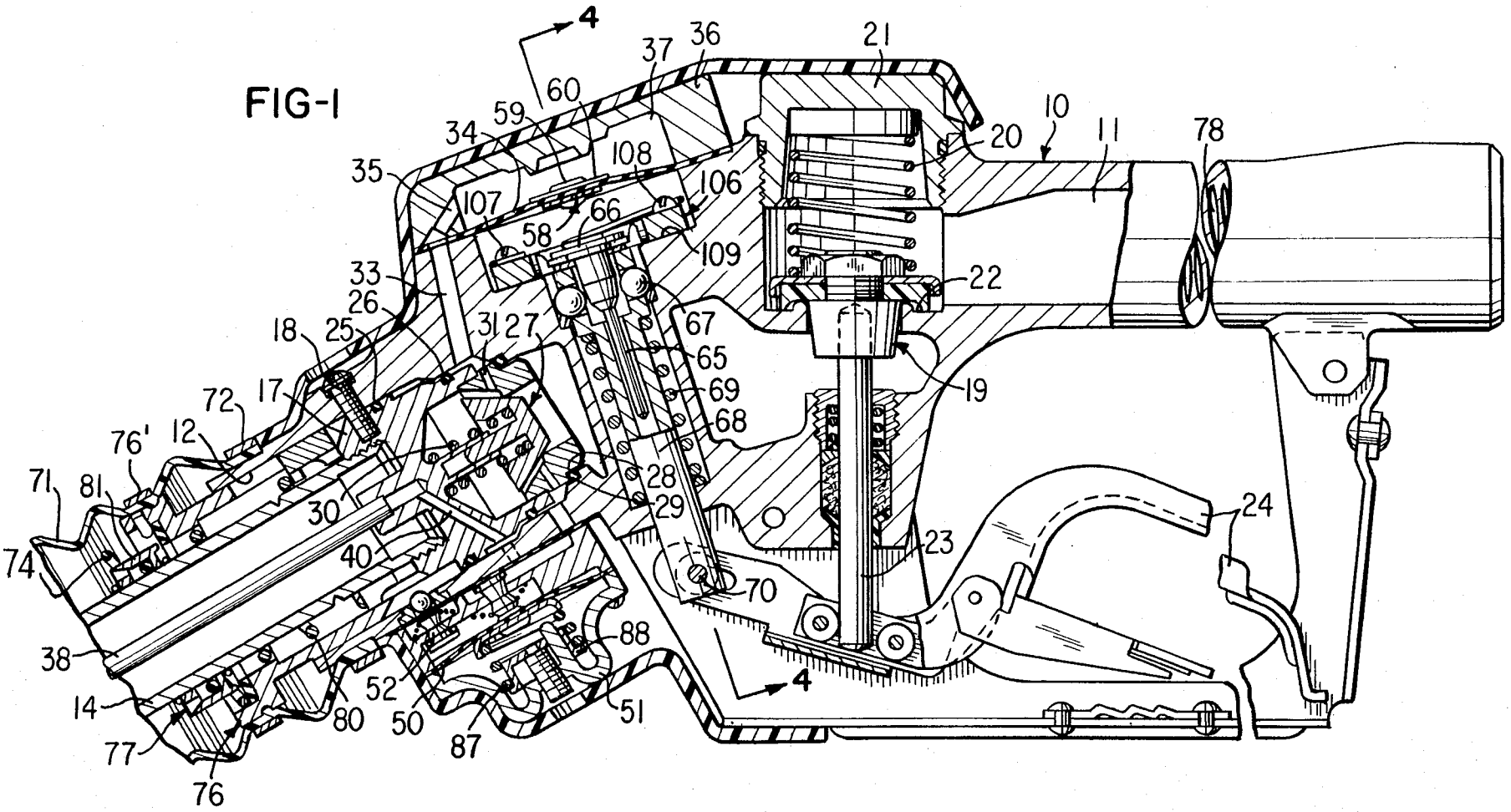
FIG. 1 is a sectional view, partly in elevation, of a portion of a nozzle having the shut-off mechanism of the present invention incorporated therein.
Figure 2:
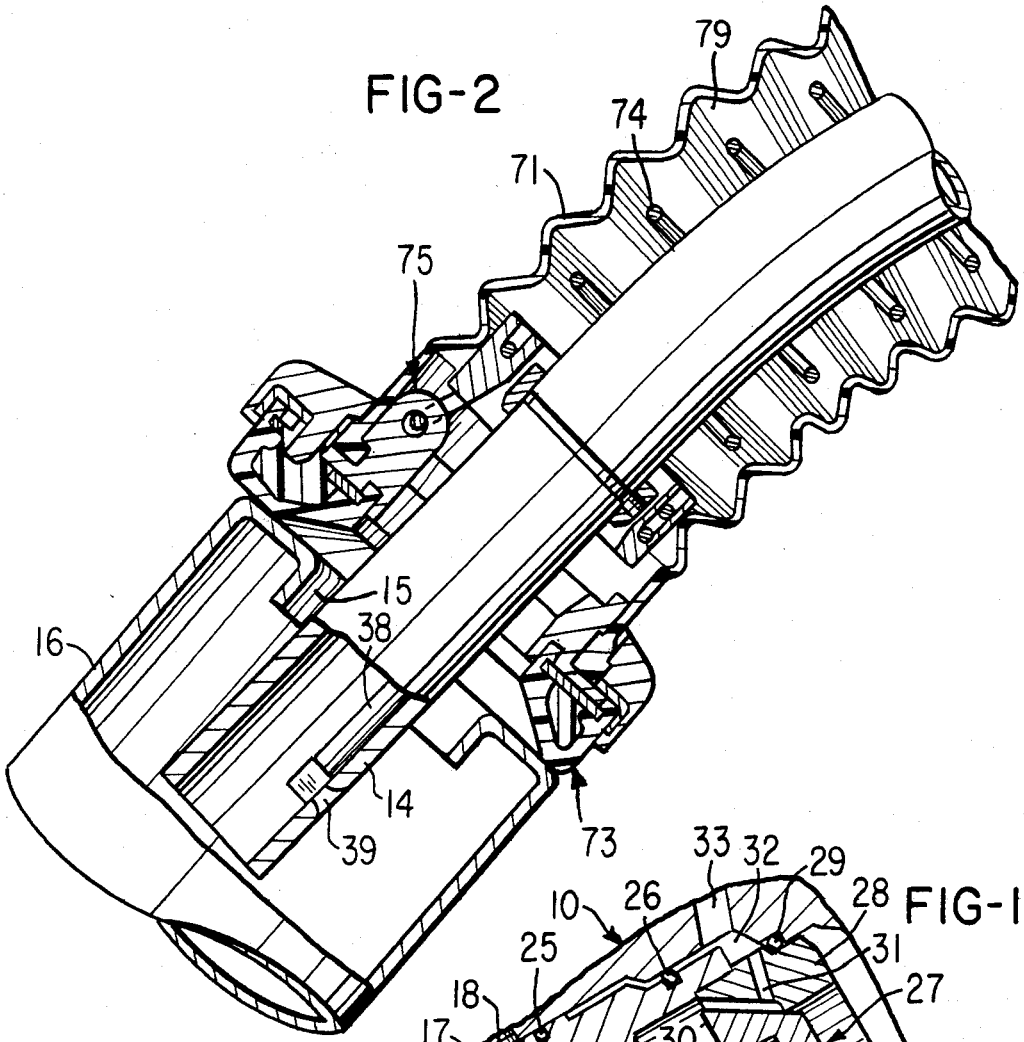
FIG. 2 is a sectional view, partly in elevation, of the remainder of the nozzle of FIG. 1 and showing its spout entering the fill pipe of a vehicle tank.

Referring to the drawings and particularly FIGS. 1 and 2, there is shown a nozzle body 10 having an inlet 11 to which a hose is connected to supply liquid such as gasoline, for example, to the interior of the body 10. The body 10 has an outlet 12 with which a spout 14 (see FIG. 2) communicates to receive liquid from the interior of the body 10. The spout 14 is adapted to be inserted within an opening 15 in a filler pipe 16 of a vehicle tank such as an automobile fuel tank, for example. The spout 14 has an end threaded in a spout adapter 17 (see FIG. 1), which is connected to the outlet 12 of the body 10 by a screw 18.

The body 10 has a first or main poppet valve 19 supported therein for controlling the flow of liquid from the inlet 11 to the interior of the body 10 and from the interior of the body 10 to the outlet 12. A spring 20, which has one end acting against a cap 21 threaded into the nozzle body 10, has its other end acting against the poppet valve 19 to continuously urge the poppet valve 19 to its closed position against a valve seat 22.

The main poppet valve 19 has a stem 23 connected thereto with its lower portion extending exteriorly of the nozzle body 10 in the manner more particularly shown and described in U.S. Pat. No. 3,653,415 to Boudot et al. The lower end of the stem 23, which is slidably disposed within the body 10, is moved by a manually operated handle 24 to move the main poppet valve 19 to its open position.

Sealing rings 25 and 26 are disposed between the spout adapter 17 and the body 10. Thus, air cannot enter between the body 10 and the spout adapter 17 from exterior of the body 10.

Figure 1A:
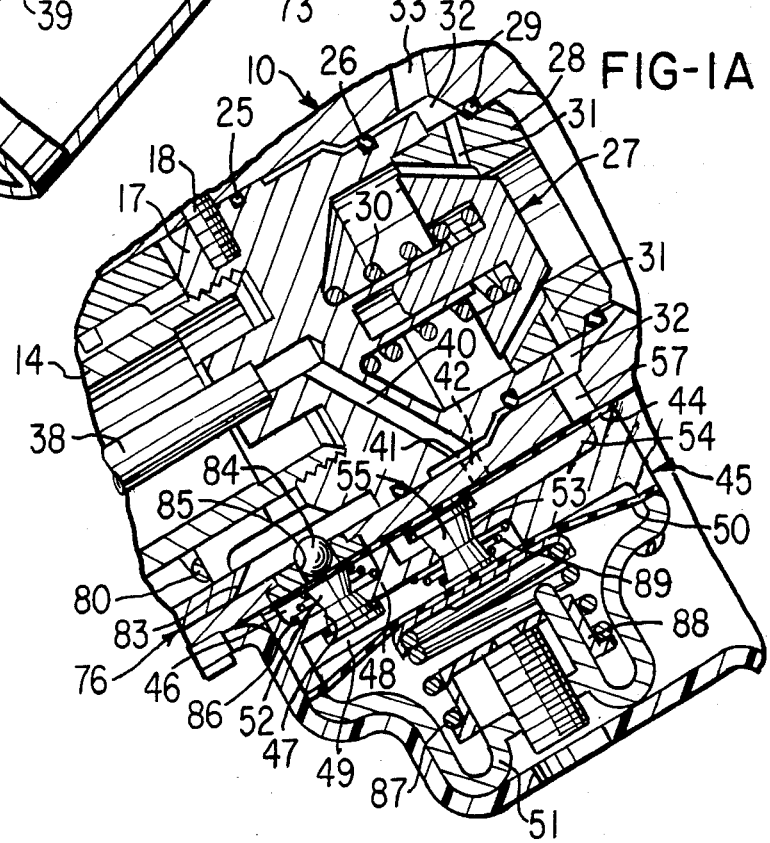
FIG. 1A is an enlarged fragmentary sectional view of a portion of the nozzle body of the nozzle of FIG. 1.

A second poppet valve 27 is slidably mounted in the spout adapter 17 and is continuously urged by a spring 30 into engagement with a seat ring 28 (see FIG. 1A); which is secured to the spout adapter 17 and has a sealing ring 29 disposed therebetween to prevent leakage therebetween. Thus, only the pressure of liquid going from the inlet 11 (see FIG. 1) and past the main poppet valve 19 can overcome the spring 30 (see FIG. 1A) and move the poppet valve 27 to an open position.

As the liquid flows between the poppet valve 27 and the seat ring 28, a venturi effect is created in radially extending passages 31 in the seat ring 28. The outer ends of the passages 31 communicate with an annular chamber 32, which is formed between the body 10, the spout adapter 17, and the seat ring 28. The passages 31 communicate through the annular chamber 32, a passage 33 in the body 10, an opening in a first diaphragm 34 (see FIG. 1), and a passage 35 in a cap 36 to a first chamber 37, which is formed between the first diaphragm 34 and the cap 36. The first diaphragm 34 has its outer surface exposed to the ambient pressure.

The annular chamber 32 (see FIG. 1A) also communicates with a vacuum tube 38, which is connected with an opening 39 (see FIG. 2) in the spout 14 adjacent the discharge or free end of the spout 14. The tube 38 communicates through a passage 40 (see FIG. 1) in the spout adapter 17 with an annular chamber 41 (see FIG. 1A), which is formed between the sealing rings 25 and 26, the spout adapter 17, and the body 10. The annular chamber 41 communicates through a passage 42 in the nozzle body 10, an opening (not shown) in a gasket 44, which is disposed between the body 10 and a housing 45 secured to the body 10, a chamber (not shown) in the housing 45, and passages (not shown) in the housing 45 with the body 10, to a chamber 46 in the housing 45. U.S. Pat. No. 4,286,635 to McMath et al discloses the type of relation between the chamber, the passages (not shown) in the housing 45, the chamber (not shown) in the housing 45, the opening (not shown) in the gasket 44, and the passage 42.

The chamber 46 in the housing 45 communicates through a passage 47 in a divider 48 of the housing 45 with a chamber 49, which is formed between the divider 48 and a diaphragm 50. A cap 51 holds the diaphragm 50 on the housing 45. The flow through the passage 47 is controlled by a poppet valve 52.

The chamber 49 communicates through a passage 53 in the divider 48 of the housing 45 with a chamber 54, which is formed within the housing 45 between the divider 48 and the gasket 44. The passage 53 is controlled by a poppet valve 55, which is associated with the diaphragm 50. The chamber 54 communicates through an opening (not shown) in the gasket 44 and a passage 57 in the body 10 with the annular chamber 32.

Accordingly, as long as the poppet valves 52 and 55 are open and the opening 39 (see FIG. 2) is not closed due to the liquid within the tank reaching a predetermined level that indicates that the tank is filled, the venturi effect created by the flow of the liquid between the seat ring 28 (see FIG. 1) and the poppet valve 27 draws air through the tube 38 to create a partial vacuum within the first chamber 37. However, as soon as the opening 39 (see FIG. 2) is blocked, or the valve 52 (see FIG. 1) is closed, or the valve 55 (see FIG. 1A) is closed, the first chamber 37 (see FIG. 1) has its pressure reduced due to the air therein being drawn therefrom because of the venturi effect in the radial passages 31 whereby the first diaphragm 34 moves upwardly since the partial vacuum in the first chamber 37 is increased and the ambient pressure is acting on the outer surface of the first diaphragm 34. This venturi effect is more particularly described in U.S. Pat. No. 3,085,600 to Briede.

The first diaphragm 34 has a U-shaped yoke 58 (see FIG. 4) attached thereto by a rivet 59, which holds a washer 60 against the upper or interior surface of the first diaphragm 34. The yoke 58 includes an upper portion 61 bearing against the bottom or exterior surface of the first diaphragm 34, a connecting, vertical portion 62, and a base 63. The base 63 has a recess 64 (see FIG. 11) formed therein to receive a portion of a latch retaining pin 65 (see FIG. 4).

Figure 4:
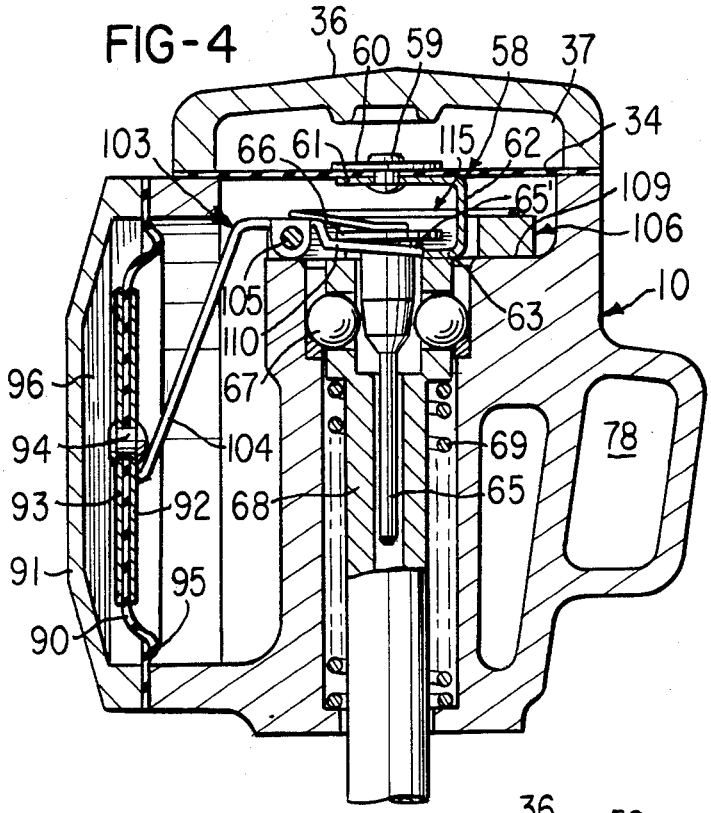
FIG. 4 is a fragmentary sectional view of a portion of the nozzle body of FIG. 1 taken substantially along line 4—4 of FIG. 1 and showing the shut-off mechanism when flow is occurring through the nozzle.

The base 63 of the yoke 58 is positioned beneath a reduced shoulder 65' of a washer 66 mounted on the latch retaining pin 65 as shown in FIG. 4. The washer 66 is mounted on a head 66' (see FIG. 10) on the upper end of the latch retaining pin 65.

When the latch retaining pin 65 is in the position shown in FIG. 4, the latch retaining pin 65 is disposed between three balls 67 (two shown), which are positioned within passages in a latch plunger 68. When the latch retaining pin 65 is in the position shown in FIG. 4, the balls 67 prevent downward movement of the plunger 68, which is slidably mounted within the body 10.

Figure 5:
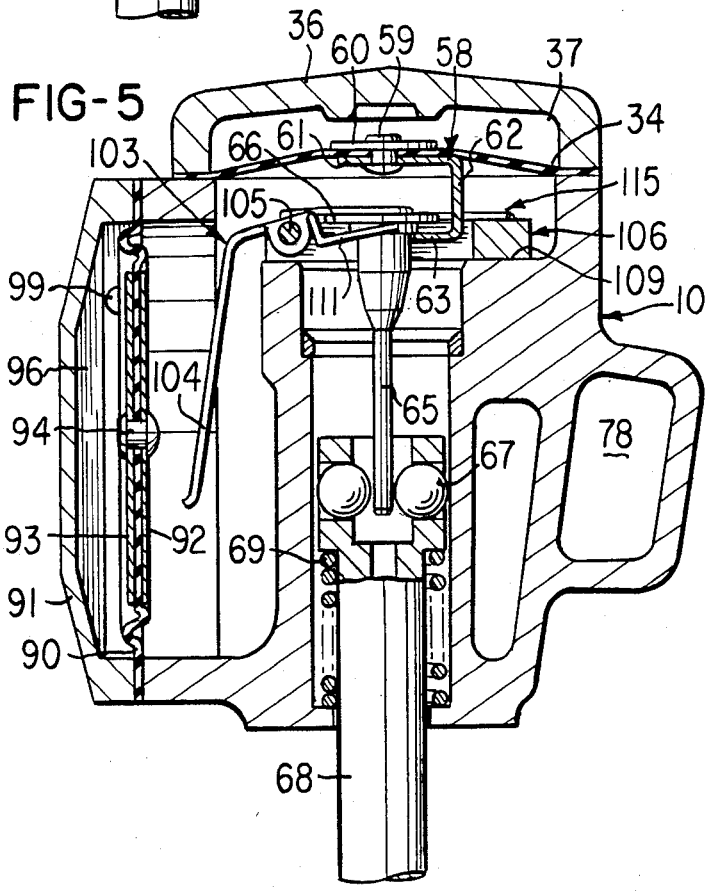
FIG. 5 is a fragmentary sectional view similar to FIG. 4 but showing the shut-off mechanism responding to the liquid in the tank being filled reaching a predetermined level.

When the first diaphragm 34 is moved upwardly to the position of FIG. 5 due to the increase in the partial vacuum within the first chamber 37 because of the liquid in the tank being filled reaching the predetermined level to block the opening 39 (see FIG. 2), the base 63 (see FIG. 5) of the yoke 58 engages the bottom of the reduce shoulder 65' of the washer 66 on the latch retaining pin 65 to move the latch retaining pin 65 upwardly with the first diaphragm 34. The upward movement of the latch retaining pin 65 disposes a tapered portion of the latch retaining pin 65 between the balls 67 whereby the balls 67 may move inwardly to allow the latch plunger 68 to move downwardly against the force of its spring 69. The correlation between the tapered portion of the latch retaining pin 65 and the latch plunger 68 is more specifically shown in U.S. Pat. No. 2,582,195 to Duerr.

The lower end of the latch plunger 68 is pivotally connected to the handle 24 (see FIG. 1) by a pivot pin 70 as more particularly shown and described in U.S. Pat. No. 3,817,285 to Wilder et al. Thus, when the first diaphragm 34 moves upwardly, as shown in FIG. 5, to cause the yoke 58 to pull the latch retaining pin 65 upwardly and release the latch plunger 68 from the balls 67, the force of the spring 20 (see FIG. 1) closes the main poppet valve 19 as more particularly shown and described in the aforesaid Wilder et al patent.

The outlet 12 of the body 10 has one end of a bellows 71, which is formed of a gasoline resistant synthetic rubber, for example, secured thereto and held thereon by a clamp 72. The other end of the bellows 71 has a sealing means 73 (see FIG. 2) removably fastened thereto. The sealing means 73 has an enlarged opening formed in its center to enable the sealing means 73 to slide along the spout 14.

A spring 74 continuously urges the bellows 71 to its extended position through one end of the spring 74 acting on a swivel plate 75 and its other end acting on a slidable member 76 (see FIG. 1), which is attached to the bellows 71 by a clamp 76'. The spring 74 is mounted so that there can be relative rotation between the swivel plate 75 (see FIG. 2), which is connected to the sealing means 73, and the spout 14.

The slidable member 76 (see FIG. 1) is a portion of a check valve 77, which blocks communication of a vapor return passage 78 (see FIG. 4) in the nozzle body 10 with an annular passage 79 (see FIG. 2), which is formed between the bellows 71 and the spout 14. Accordingly, when the spout 14 is inserted into the fill pipe opening 15 as shown in FIG. 2, the sealing means 73 engages the end of the fill pipe 16 to form a seal therewith. Thus, any vapor within the tank being filled can flow from the tank through the fill pipe opening 15 and the opening in the sealing means 73 into the annular passage 79.

When the sealing means 73 engages the end of the fill pipe 16, the sealing means 73 can no longer follow the movement of the spout 14 into the fill pipe 16. This results in the spring 74 being compressed. This causes a spring 80 (see FIG. 1) to be overcome to move the slidable member 76 away from an element 81, which is mounted on the spout 14 for movement therewith, of the check valve 77. This allows vapor to flow from the vehicle tank, which is being filled, through the fill pipe 16 (see FIG. 2), the opening 15 in the fill pipe 16, the opening in the sealing means 73, the annular passage 79, and the vapor return passage 78 (see FIG. 4) in the nozzle body 10 to a vapor return hose, which is connected to vapor recovery equipment.

Thus, the vapor recovery equipment communicates with the vehicle tank being filled to receive the vapor therefrom. However, it cannot communicate with the atmosphere because the check valve 77 (see FIG. 1) does not open until the spring 74 (see FIG. 2) has been compressed sufficiently through disposing the free end of the spout 14 within the fill pipe opening 15 and holding it therein.

The slidable member 76 (see FIG. 1) functions as an interlock sleeve to allow liquid flow through the body 10 only if the sealing means 73 (see FIG. 2) is in sealing engagement with the end of the fill pipe 16 when the spout 14 is inserted in the fill pipe opening 15 to supply the liquid thereto. The slidable member 76 (see FIG. 1) has a cam surface 83 (see FIG. 1A) cooperating with an actuator 84, which is disposed in a passage 85 in the body 10.

Accordingly, when the spout 14 (see FIG. 2) is disposed in the fill pipe opening 15 so that the sealing means 73 engages the end of the fill pipe 16 to stop movement of the sealing means 73, the continued movement of the spout 14 into the fill pipe opening 15 causes the body 10 (see FIG. 1), which has the spout 14 attached thereto through the spout adapter 17, to move relative to the slidable member 76. As a result, the actuator 84 (see FIG. 1A) moves with the body 10 into engagement with the cam surface 83 of the slidable member 76.

The engagement of the actuator 84 with the cam surface 83 of the slidable member 76 causes the actuator 84 to move the poppet valve 52 to an open position against the force of its spring 86. The opening of the poppet valve 52 allows air to flow from the inlet opening 39 (see FIG. 2) in the spout 14 and through the vacuum tube 38, the passage 40 (see FIG. 1) in the spout adapter 17, the annular chamber 41 (see FIG. 1A), the passage 42 in the body 10, the opening (not shown) in the gasket 44, the chamber (not shown) in the housing 45, the passages (not shown) in the housing 45, the chamber 46 in the housing 45, the passage 47 in the divider 48, the chamber 49, the passage 53 in the divider 48, the chamber 54, the opening (not shown) in the gasket 44, the passage 57 in the body 10, and the annular chamber 32 through the radial passages 31 in the seat ring 28. This provides a supply of air so that the partial vacuum created in the first chamber 37 (see FIG. 1) by the venturi effect is not increased.

As previously mentioned, the poppet valve 55 (see FIG. 1A), which is associated with the diaphragm 50, has one end of a spring 87 operatively associated therewith. The other end of the spring 87 acts against an adjustable cup 88 in the cap 51. A spring 89 acts against the poppet valve 55 to urge it to its closed position, but the force of the spring 89 is not as strong as the force of the adjustable spring 87, which retains the poppet valve 55 in its normally open position.

However, if the vapor pressure in the tank, which is being filled, increases beyond a predetermined pressure, the diaphragm 50 is moved against the force of the spring 87 to permit the poppet valve 55 to move to its closed position in response to the action of the spring 89. When this occurs, air from the inlet 39 (see FIG. 2) to the passages 31 (see FIG. 1) in the seat ring 28 is stopped so that the partial vacuum in the first chamber 37 is increased to cause automatic closing of the main poppet valve 19.

The use of the poppet valve 55 (see FIG. 1A) to stop flow through the nozzle body 10 is not relied upon in the shut-off mechanism of the present invention. Thus, the poppet valve 55 could be omitted, if desired.

The shut-off mechanism for automatically stopping flow through the nozzle body 10 when the pressure in the tank being filled increases beyond a predetermined pressure includes a second diaphragm 90 (see FIG. 4), which is mounted between the body 10 and a cap 91 secured to the body 10. The second diaphragm 90, which is disposed in a plane substantially perpendicular to a plane containing the first diaphragm 34, has its outer or exterior surface exposed to the ambient pressure.

The second diaphragm 90 has a pair of washers 92 and 93 secured to opposite sides thereof by a rivet 94. The second diaphragm 90 has a convolution 95 between the ends of the circumferential edges of the washers 92 and 93 and the outer circumferential portion of the second diaphragm 90 retained between the nozzle body 10 and the cap 91.

Figure 7:
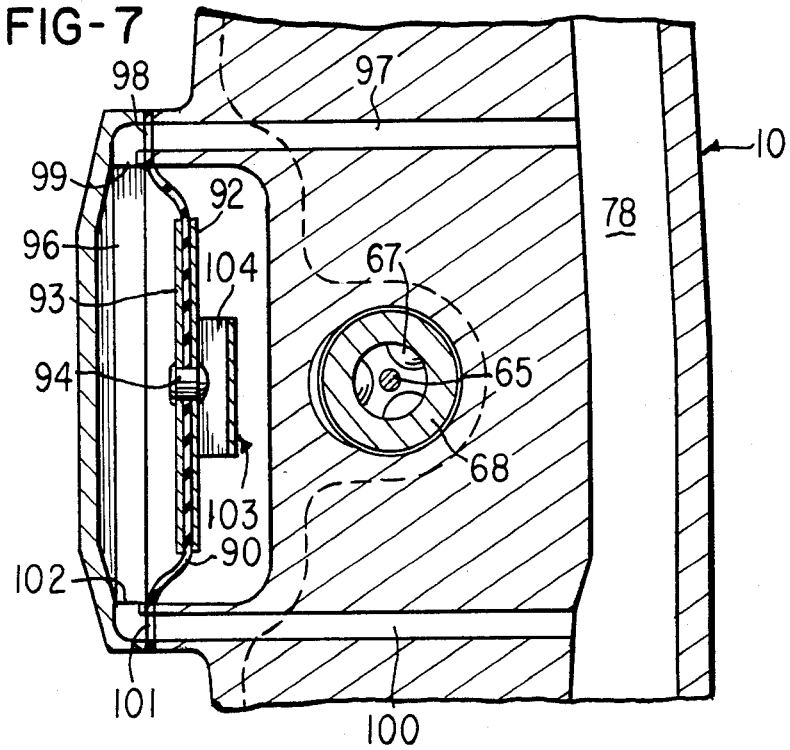
FIG. 7 is a fragmentary sectional view of the portion of the nozzle body of FIG. 6 and taken along line 7—7 of FIG. 6.

A second chamber 96 is formed between the second diaphragm 90 and cap 91. As shown in FIG. 7, the second chamber 96 communicates with the vapor return passage 78 in the nozzle body 10. The vapor return passage 78 communicates with the second chamber 96 through a first passage 97 in the nozzle body 10, a first opening 98 in the second diaphragm 90, and a first passage 99 in the cap 91. The vapor return passage 78 also communicates through a second passage 100 in the nozzle body 10, a second opening 101 in the second diaphragm 90, and a second passage 102 in the cap 91 with the second chamber 96. Thus, if liquid should flow into the vapor return passage 78 from the tank being filled, it can be more easily removed from the second chamber 96 through the passages 97 and 100 rather than through a single passage when the nozzle body 10 is supported on its pump pedestal.

Figure 6:
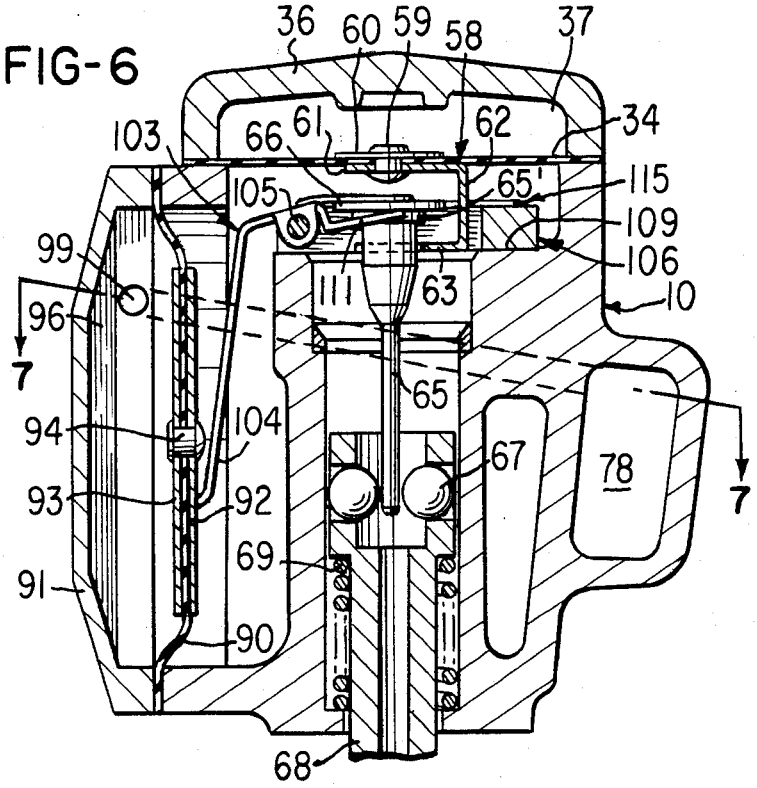
FIG. 6 is a fragmentary sectional view similar to FIGS. 4 and 5 but showing the shut-off mechanism activated when the pressure in the tank being filled exceeds a predetermined pressure.

When the second diaphragm 90 is moved away from the cap 91 by an increase in the vapor pressure in the tank being filled and transmitted to the second chamber 96, the movement of the second diaphragm 90 to the position of FIG. 6 causes pivoting of a trip lever 103 through the second diaphragm 90 engaging a portion 104 of the trip lever 103. The trip lever 103 is pivotally mounted by a pivot pin 105 on a carrier 106. The carrier 106 is secured by screws 107 (see FIG. 12) and 108 to the nozzle body 10 (see FIG. 6) so that the carrier 106 rests on a flat surface 109 of the nozzle body 10.

The trip lever 103 has a second portion 110 (see FIG. 9) having a pair of forks or fingers 111 and 112 at its end. The forks 111 and 112 extend around the shoulder 65' (see FIG. 10) of the washer 66 on the latch retaining pin 65 and beneath the remainder of the washer 66. Thus, when the second diaphragm 90 is moved to the position of FIG. 6 because of the pressure in the tank being filled exceeding the predetermined presssure, the trip lever 103 pivots about the pivot pin 105 and the forks 111 and 112 (see FIG. 9) of the second portion 110 of the trip lever 103 engage the bottom surface of the washer 66 (see FIG. 6) to cause the latch retaining pin 65 to be lifted upwardly. As a result, the latch plunger 68 is released from the balls 67 and the force of the spring 20 (see FIG. 1) closes the main poppet valve 19 as more particularly shown and described in the aforesaid Wilder et al patent.

When the trip lever 103 is pivoted to the position shown in FIG. 6, there is no movement of the yoke 58 or the first diaphragm 34. This is because the base 63 (see FIG. 11) of the yoke 58 has the recess 64 therein so that the latch retaining pin 65 (see FIG. 6) can move upwardly relative to the yoke 58 without affecting the yoke 58 or the first diaphragm 34 as shown in FIG. 6.

When the second diaphragm 90 expands to pivot the trip lever 103 to the position of FIG. 6, this increased pressure in the tank being filled also is transmitted to the first chamber 37. This would tend to push the first diaphragm 34 downwardly whereby such downward movement would interfere with upward movement of the latch retaining pin 65 by the trip lever 103. However, the base 63 of the yoke 58 has its bottom surface engaging a portion of the flat surface 109 of the nozzle body 10. As a result, there can be no downward movement of the first diaphragm 34 or the yoke 58 so that there is no interference in the movement of the latch retaining pin 65 by the second diaphragm 90 causing pivoting of the trip lever 103.

A spring 115 is employed to return the trip lever 103 to the position of FIG. 4 when the second diaphragm 90 is no longer expanded because of the pressure in the tank being filled no longer exceeding the predetermined pressure. The spring 115 also returns the yoke 58 and the first diaphragm 34 from the position of FIG. 5 to the position of FIG. 4 when the first chamber 37 no longer has the increased partial vacuum therein. The spring 115 also urges the latch retaining pin 65 to the position of FIG. 4 whenever the latch retaining pin 65 has been raised. Thus, the spring 115, which exerts its force in the same direction as that in which the latch plunger 68 moves when released, is used to return each of the first diaphragm 34, the second diaphragm 90, and the latch retaining pin 65 to the at rest or latched position of FIG. 4.

Figure 3:
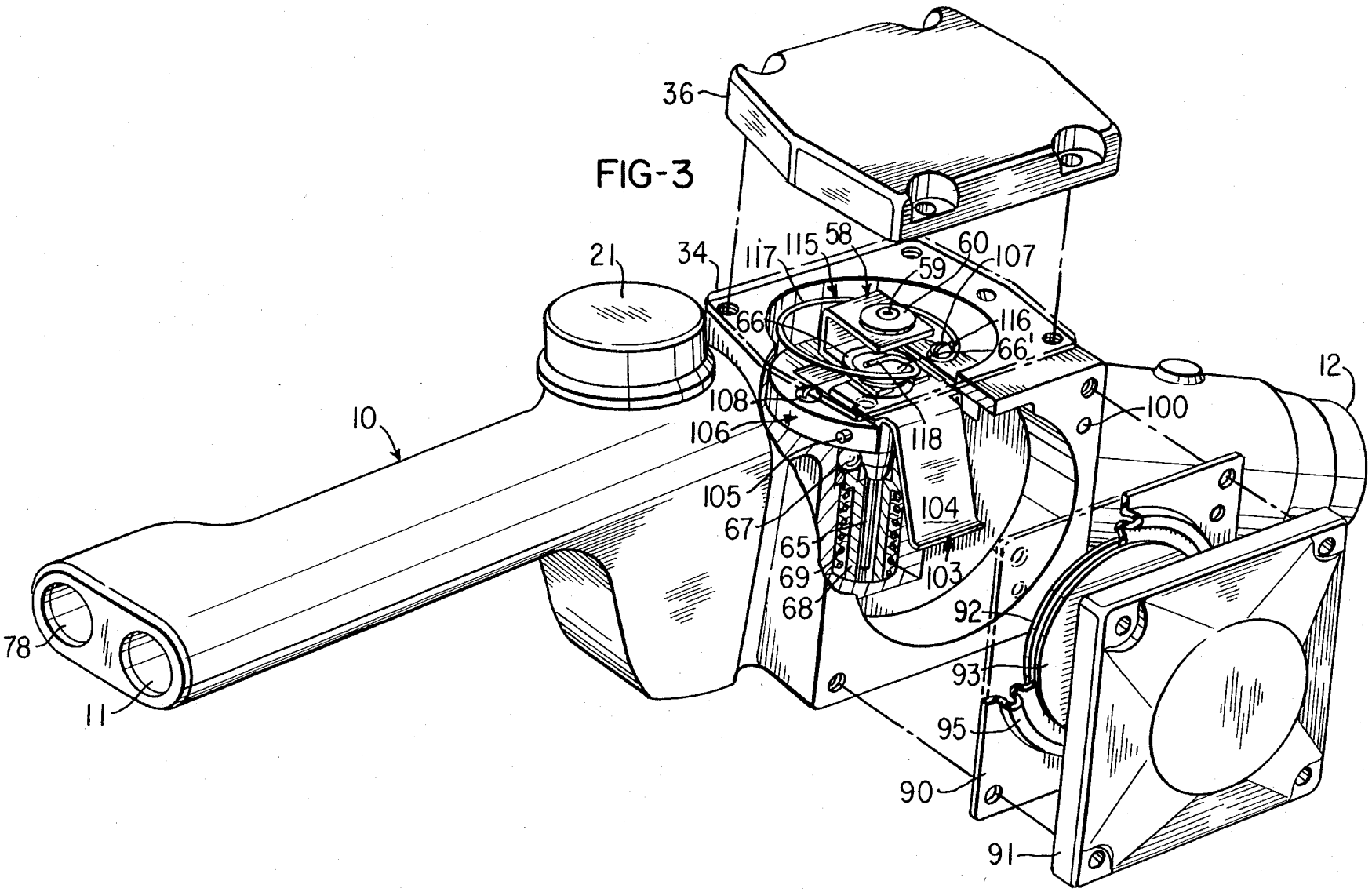
FIG. 3 is a perspective view, partly in section and partly exploded, of the nozzle body of the nozzle of FIG. 1.

The spring 115 includes a curved portion 116 (see FIG. 12), which fits beneath the head of the screw 107 to hold one end of the spring 115. The spring 115 includes a long circular portion 117 terminating in a hook portion 118 at its other end. The spring 115 has its hook portion 118 bearing against the top of the washer 66 and the top of the head 66′ of the latch retaining pin 65 as shown in FIG. 3. Thus, the spring 115 exerts its force on the trip lever 103 through the washer 66 and its force on the yoke 58 (see FIG. 4) through the base 63 of the yoke 58 being engaged by the shoulder 65′ on the washer 66.

Considering the operation of the shut-off mechanism of the vapor recovery nozzle of the present invention, the poppet valve 52 (see FIG. 1A) is normally in a closed position and the poppet valve 55 is normally in an open position. With the valves 52 and 55 in these positions and the spout 14 (see FIG. 2) not disposed in the fill pipe opening 15, opening of the main poppet valve 19 (see FIG. 1) by the handle 24 to cause liquid to flow through the body 10 produces an increased partial vacuum in the first chamber 37 whereby the main poppet valve 19 is automatically closed shortly after being opened so that only a couple of ounces of liquid can pass through the nozzle body 10 and the spout 14 when the handle 24 moves the poppet valve 19 to an open position without the sealing means 73 (see FIG. 2) having made a seal with the fill pipe 16.

When the spout 14 is disposed in the fill pipe 16 a sufficient distance that the sealing means 73 engages the end of the fill pipe 16 and a sufficient force is exerted on the spout 14 to provide a seal around the fill pipe opening 15 by the sealing means 73, then the poppet valve 52 (see FIG. 1) is moved to its open position through the relative motion of the body 10, the spout 14, and the spout adapter 17 with respect to the slidable member 76. This relative motion results in the cam surface 83 (see FIG. 1A) of the slidable member 76 moving the actuator 84 against the force of the spring 86 to open the poppet valve 52 through the actuator 84 acting against the end of the poppet valve 52 via the flexibility of the gasket 44.

With the poppet valve 52 open, there is an effective seal by the sealing means 73 (see FIG. 2) against the end of the fill pipe 16 so that liquid can be supplied to the tank from the body 10 (see FIG. 1). Thus, vapor will flow from the tank, which is being filled, to the annular passage 79 (see FIG. 2).

Flow will continue through the body 10 (see FIG. 1) and the spout 14 until the tank is filled to the predetermined level at which the inlet 39 (see FIG. 2) to the vacuum tube 38 is blocked by the liquid in the tank being filled. When this occurs, the partial vacuum in the first chamber 37 (see FIG. 1) increases because of the absence of air from the inlet 39 (see FIG. 2) to the radial passages 31 (see FIG. 1) in the seat ring 28 so that the first diaphragm 34 moves upwardly to the position of FIG. 5. This raises the yoke 58 to lift the latch retaining pin 65 so that automatic closing of the main poppet valve 19 (see FIG. 1) occurs.

If the pressure in the tank should exceed a predetermined pressure, then the second diaphragm 90 (see FIG. 6) expands to pivot the trip lever 103 about the pivot pin 105. This causes the forks 111 (see FIG. 9) and 112 of the trip lever 103 to lift the latch retaining pin 65, as shown in FIG. 6, so that the main poppet valve 19 (see FIG. 1) is automatically closed.

If the poppet valve 55 (see FIG. 1A) is employed, the poppet valve 55 could be moved to its closed position by the diaphragm 50 when the vapor pressure in the tank exceeded the predetermined pressure. If this were to occur, the partial vacuum in the first chamber 37 (see FIG. 1) would again be increased in the same manner as when the inlet 39 (see FIG. 2) to the vacuum tube 38 is blocked by the level of the liquid in the tank being filled since each effectively causes an increase in the partial vacuum in the first chamber 37 (see FIG. 1) because of the inability of the venturi to draw air from the inlet 39 (see FIG. 2) through the radial passages 31 (see FIG. 1A) in the seat ring 28. However, as previously mentioned, the poppet valve 55 may be omitted if desired. Even if the poppet valve 55 remains, the movement of the first diaphragm 34 to the position of FIG. 5 at the same time that there is movement of the trip lever 103 to the position of FIG. 6 by the second diaphragm 90 would not affect the movement of the trip lever 103 by the second diaphragm 90.

The use of the second diaphragm 90 avoids any problem of the venturi ceasing to function, for any reason, when the pressure in the tank being filled exceeds the predetermined pressure. Thus, the second diaphragm 90 does not depend upon the venturi as does the first diaphragm 34. The only danger from over filling the tank is the loss of the gasoline. However, there is the danger of the tank rupturing if the pressure therein should exceed the predetermined pressure by a substantial amount, and there is no way that the user would know this.

Furthermore, if the liquid in the tank should exceed the predetermined level, it would flow inside of the bellows 71 (see FIG. 1) and eventually block the vapor return passage 78 (see FIG. 4). As a result, the increased pressure in the second chamber 96 would shut down the flow through the nozzle body 10 prior to a substantial leakage of gasoline from the tank being filled.

Figure 13:
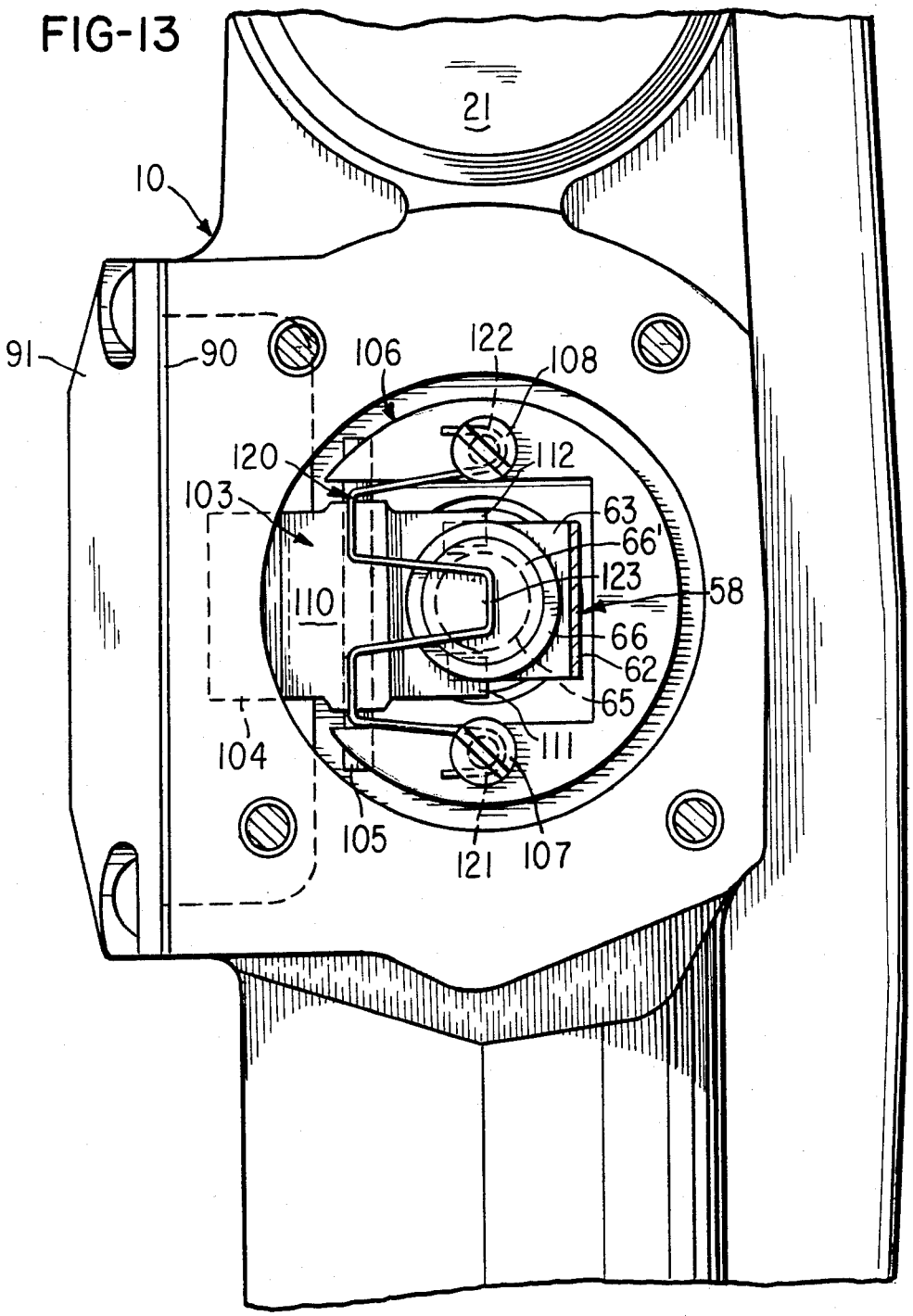
FIG. 13 is a top plan view of the automatic shut-off mechanism of the present invention having a different type of spring for acting on the latch retaining pin and the diaphragms.

Referring to FIG. 13, there is shown a spring 120, which is used in place of the spring 115 (see FIG. 12). The spring 120 (see FIG. 13) performs the same functions as the spring 115 (see FIG. 12). The spring 120 (see FIG. 13) has its ends 121 and 122 curved to fit beneath the screws 107 and 108, respectively. The spring 120 has a central portion 123 acting on the washer 66 and the head 66′ of the latch retaining pin 65 to exert a force on the latch retaining pin 65.

Referring to FIG. 14, there is shown a portion of a nozzle body 130, which is similar to the nozzle body 10. The same elements will be identified in this embodiment with the same numerals as were used to identify the same elements in the nozzle body 10 in FIG. 1.

The nozzle body 130 does not have the adjustable cup 88 of FIG. 1. Instead, a spring 131 acts against a fixed cap 132 to provide a fixed spring rate acting on the poppet valve 55. Because of the response of the second diaphragm 90 (see FIG. 15) to the pressure in the tank being filled, an adjustable setting of the spring 131 is not required. As previously mentioned relative to the embodiment of FIG. 1, the poppet valve 55 could be omitted, if desired.

The nozzle body 130 (see FIG. 15) has the vapor recovery passage 78 communicating with the second chamber 96 through two passages 133 (one shown) in the same manner as shown in FIG. 7 for the two passages 97 and 100.

The nozzle body 130 (see FIG. 15) uses a conical coil spring 134 instead of the spring 115 (see FIG. 3). The spring 134 (see FIG. 15), which has a better spring rate than the spring 115 (see FIG. 3), functions in the same manner as the spring 115.

The bottom end of the spring 134 (see FIG. 15) fits around a tab or projection 135 on the upper end of a latch pin 136, which is the same as the latch pin 65 (see FIG. 1) except for the tab or projection 135 (see FIG. 15). The tab or projection 135 functions as a guide for the lower end of the spring 134.

The upper end of the spring 134 fits around a circular embossed area 137 (see FIG. 16), which is a depression, of a spring retainer 138. The spring retainer 138 is supported on a carrier 139 (see FIG. 14), which is a stamping, by a screw 140. The screw 140 and a screw 141 attach the carrier 139 to an insert 142, which is formed of a suitable plastic such as acetal resin, for example. The insert 142 has the lower surface of its mounting flange 143 resting on a flat surface 144 of the nozzle body 130 and is attached to the nozzle body 130 by the screws 140 and 141.

The trip lever 103 (see FIG. 15) is pivotally mounted on the carrier 139 by the pivot pin 105 in the same manner as the trip lever 103 is pivotally mounted on the carrier 106 (see FIG. 10). The operation of the nozzle body 130 (see FIG. 14) with the spring 134 is the same as that described for the nozzle body 10 (see FIG. 3) with the spring 115.

An advantage of this invention is that pressure shut off of flow through a nozzle body does not depend upon the venturi utilized for creating shut off when the liquid in the tank reaches the predetermined level. Another advantage of this invention is that the diaphragm, which is responsive to the partial vacuum created by the liquid in the tank reaching a predetermined level, cannot interfere with the shut off due to the pressure in the tank exceeding the predetermined pressure. A further advantage of this invention is that shut off due to liquid overflow can be produced by the diaphragm which is responsive to the pressure in the vapor return passage of the nozzle if the venturi should fail to increase the partial vacuum within the chamber having the diaphragm that moves in response to the increased partial vacuum.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

What is claimed is:

1. An automatic shut-off nozzle comprising a body having an inlet and an outlet, a valve in said body controlling flow of liquid from said inlet to said outlet, resilient means continuously urging said valve to its closed position, manual operated means to move said valve to an open position against the force of said resilient means, said manual operated means, including moving means for moving said valve to an open position, means slidably mounted in said body for sliding therein, and means to pivotally connect said moving means to said slidably mounted means a spout communicating with said outlet, said spout being insertable into a tank through an opening therein to allow the liquid to be dispensed therein, holding means for holding said slidably mounted means in a position in which said moving means can hold said valve in an open position against the force of said resilient means when said holding means is in a holding position, release means for holding said holding means in the holding position, said release means being movable in one direction to release said slidably mounted means of said manual operated means through ceasing to hold said holding means in the holding position in response to either pressure in the tank exceeding a predetermined pressure or the liquid in the tank reaching a predetermined level to allow closing of said valve and stoppage of liquid flow through said body through said slidably mounted means being movable in a direction opposite to the one direction in which said release means moves, first means communicating with the tank and causing movement of said rêlease means in the one direction in resopnse to the liquid reaching the predetermined level in the tank, said first means including a first chamber communicating with the tank, a first diaphragm forming a wall of said first chamber, and first separate means separate from said release means and said holding means to act on said release means to cause movement of said release means in the one direction in response to said first diaphragm moving in response to the liquid reaching the predetermined level in the tank, and second means communicating with the tank separately from said first means and responsive only to the pressure in the tank exceeding the predetermined pressure, said second means including a second chamber communicating with the tank, a second diaphragm forming a wall of said second chamber and responsive only to the pressure in the tank exceeding the predetermined pressure, and second separate means separate from said release means and said holding means to act on said release means to cause movement of said release means in the one direction in response to said second diaphragm moving in response to the pressure in the tank exceeding the predetermed pressure.

2. An automatic shut-off nozzle comprising a body having an inlet and an outlet, a valve in said body controlling flow of liquid from said inlet to said outlet, manual operated means controlling the operation of said valve, a spout communicating with said outlet, said spout being insertable into a tank through an opening therein to allow the liquid to be dispensed therein, release means movable in one direction to release said manual operated means in response to either pressure in the tank exceeding a predetermined pressure or the liquid in the tank reaching a predetermined level and acting on said manual operated means to allow closing of said valve and stoppage of liquid flow through said body, first means communicating with the tank and causing movement of said release means in the one direction in response to the liquid reaching the predetermined level in the tank, said first means including a first chamber communicating with the tank, a first diaphragm forming a wall of said first chamber, and first separate means separate from said release means to act on said release means to cause movement of said release means in the one direction in response to said first diaphragm moving in response to the liqiud reaching the predetermined level in the tank, second means communicating with the tank separately from said first means and responsive only to the pressure in the tank exceeding the predetermined pressure, said second means including a second chamber communicating with the tank, a second diaphragm forming a wall of said second chamber and responsive only to the pressure in the tank exceeding the predetermined pressure and second separate means separate from said release means to act on said release means to cause movement of said release means in the one direction in response to said second diaphragm moving in response to the pressure in the tank exceeding the predetermined pressure, and said second separate means at said second means including pivotally mounted means having a first portion cooperating with said release means and a second portion cooperating with said second diaphragm, said second portion being movable by said second diaphragm when the pressure in the tank exceeds the predetermined pressure to pivot said first portion into engagement with said release means to move said release means in the one direction to cause closing of said valve.

3. The nozzle according to claim 2 in which said first separate means includes connected means connected to said first diaphragm to engage said release means to move said release means in the one direction to cause closing of said valve when the liquid in the tank reaches the predetermined level.

4. The nozzle according to claim 3 in which said connected means of said first separate means includes means to prevent movement of said first diaphragm when the pressure in the tank exceeds the predetermined pressure so that movement of said release means in the one direction by said second separate means is not affected.

5. The nozzle according to claim 4 including a single spring acting on said release means in a direction opposite to the one direction to urge said release means to its at rest position, said first diaphragm to its at rest position, and said second diaphragm to its at rest position.

6. The nozzle according to claim 1 in which said first separate means includes connected means connected to said first diaphragm to engage said release means to move said release means in the one direction to cause closing of said valve when the liquid in the tank reaches the predetermined level.

7. The nozzle according to claim 6 in which said connected means of said first separate means includes means to prevent movement of said first diaphragm when the pressure in the tank exceeds the predetermined pressure so that movement of said release means in the one direction by said second separate means is not affected.

8. The nozzle according to claim 7 including a single spring acting on said release means in a direction opposite to the one direction to urge said release means to its at rest position, said first diaphragm to its at rest position, and said second diaphragm to its at rest position.

9. An automatic shut-off nozzle comprising a body having an inlet and an outlet, a valve in said body controlling flow of liquid from said inlet to said outlet, manual operated means controlling the operation of said valve, a spout communicating with said outlet, said spout being insertable into a tank through an opening therein to allow the liquid to be dispensed therein, release means movable in one direction to release said manual operated means in response to either pressure in the tank exceeding a predetermined pressure or the liquid in the tank reaching a predetermined level and acting on said manual operated means to allow closing of said valve and stoppage of liquid flow through said body, first means communicating with the tank and causing movement of said release means in the one direction in response to the liquid reaching the predetermined level in the tank, said first means including a first chamber communicating with the tank, a first diaphragm forming a wall of said first chamber, and first separate emans separate from said release means to act on said release means to cause movement of said release means in the one direction in response to said first diaphragm moving in response to the liquid reaching the predetermined level in the tank, and second means communicating with the tank separately from said first means and responsive only to the pressure in the tank exceeding the predetermined pressure, said second means including a second chamber communicating with the tank, a second diaphragm forming a wall of said second chamber and responsive only to the pressure in the tank exceeding the predetermined pressure, and second separate means separate from said release means to act on said release means to cause movement of said release means in the one direction in response to said second diaphragm moving in response to the pressure in the tank exceeding the predetermined pressure, said first and second diaphragm being disposed in planes substantially perpendicular to each other.

10. An automatic shut-off nozzle comprising a body having an inlet and an outlet, a valve in said body controlling flow of liquid from said inlet manual operated means controlling the operation of said valve a spout communicating with said outlet, said spout being insertable into a tank through an opening therein to allow the liquid to be dispensed therein, release means movable in one direction to release said manual operated means in response to either pressure in the tank exceeding a predetermined pressure or the liquid in the tank reaching a predetermined level and acting on said manual operated means to allow closing of said valve and stoppage of liquid flow through said body, a first chamber, a first diaphragm forming a wall of said first chamber, means communicating said first chamber with the tank, said first diaphragm having its exterior surface exposed to the atmosphere so as to be subjected to atmospheric pressure, a second chamber, a second diaphragm forming a wall of said chamber, said second diaphragm having its exterior surface exposed to the atmosphere so as to be subjected to atmospheric pressure, vapor return means communicating the tank with a vapor collecting source, means communicating said second chamber with said vapor return means, first responsive means responsive to said first diaphragm moving in response to the liquid in the tank reaching the predetermined level to act on said release means to move said release means in the one direction to cause movement of said valve to its closed position, and second responsive means responsive to said second diaphragm moving in rsponse to the pressure in the tank exceedig the predetermined pressure to act on said release means to move said release means in the one direction to cause movement of said valve to its closed position, said second responsive means being separate from said first responsive means.

11. An automatic shut-off nozzle comprising a body having an inlet and an outlet, a valve in said body controlling flow of liquid from said inlet, manual operated means controlling the operation of said valve, a spout communicating with said outlet, said spout being insertable into a tank through an opening therein to allow the liquid to be dispensed therein, release means movable in one direction to release said manual operated means in response to either pressure in the tank exceeding a predetermined pressure or the liquid in the tank reaching predetermined level and acting on said manual operated means to allow closing of said valve and stoppage of liquid through said body, a first chamber, a first diaphragm forming a wall of said first chamber, means communicating said first chamber with the tank, said first diaphragm having its exterior surface subjected to atmospheric pressure, a second chamber, a second diaphragm forming a wall of said chamber, said second diaphragm having its extrior surface subjected to atmospheric pressure, vapor return means communicating the tank with a vapor collecting source, means communicating said second chamber with said vapor return means, first responsive means responsive to said first diaphragm moving in response to the liquid in the tank reaching the predetermined level to act on said release means to move said release means in the one direction to cause movement of said valve to its closed position, second responsive means responsive to said second diaphragm moving in response to the pressure in the tank exceeding the predetermined pressure to act on said release means to move said release means in the one direction to cause movement of said valve to its closed position, said second responsive means being separate from said first responsive means, and said second responsive means including pivotally mounted means having a first portion cooperating with said release means and a second portion cooperating with said second diaphragm, said second portion being movable by said second diaphragm when the pressure in the tank exceed the predetermined pressure to pivot said first portion into engagement with said release means to move said release means in the one direction to cause closing of said valve.

12. The nozzle according to claim 11 in which said first responsive means includes connected means connected to said first diaphragm to engage said release means to move said release means in the one direction to cause closing of said valve when the liquid in the tank reaches the predetermined level.

13. The nozzle according to claim 12 in which said connected means of said first responsive means includes means to prevent movement of said first diaphragm when the pressure in the tank exceeds the predetermined pressure so that movement of said release means in the one direction by said second responsive means is not affected.

14. The nozzle according to claim 13 including a single spring acting on said release means in a direction opposite to the one direction to urge said release means to its at rest position, said first diaphragm to its at rest position, and said second diaphragm to its at rest position.

15. The nozzle according to claim 14 in which said means communicating said second chamber with said vapor return means includes two separate communication passages connecting said second chamber and said vapor return means, each of said separate communication passages communicating with a different portion of said second chamber.

16. The nozzle according to claim 10 in which said first responsive means includes connected means connected to said first diaphragm to engage said release means to move said release means in the one direction to cause closing of said valve when the liquid in the tank reaches the predetermined level.

17. The nozzle according to claim 16 in which said connected means of said first responsive means includes means to prevent movement of said first diaphragm when the pressure in the tank exceeds the predetermined pressure so that movement of said release means in the one direction by said second responsive means is not affected.

18. The nozzle according to claim 10 including a single spring acting on said release means in the one direction to urge said release means to its at rest position, said first diaphragm to its at rest position, and said second diaphragm to its at rest position.

19. The nozzle according to claim 10 in which said means communicating said second chamber with said vapor return means includes two separate communication passages connecting said second chamber and said vapor recovery means, each of said separate communication passages communicating with a different portion of said second chamber.

20. An automatic shut-off nozzle comprising a body having an inlet and an outlet, a valve in said body controlling flow of liquid from said inlet, manual operated means controlling the operation of said valve, a spout communicating with said outlet, said spout being insertable into a tank through an opening therein to allow the liquid to be dispensed therein, release means movable in one direction to release said manual operated means in response to either pressure in the tank exceeding a predetermined pressure or the liquid in the tank reaching a predetermined level and acting on said manual operated means to allow closing of said valve and stoppage of liquid flow through said body, a first chamber, a first diaphragm forming a wall of said first chamber, means communicating said first chamber with the tank, said first diaphragm having its exterior surface subjected to atmospheric pressure, a second chamber, a second diaphragm forming a wall of said chamber, said second diaphragm having its exterior surface subjected to atmospheric pressure, vapor return means communicating the tank with the vapor collection source, means communicating said second chamber with said vapor return means, said first and second diaphragm being disposed in planes substantially perpendicular to each other, first responsive means responsive to said first diaphragm moving in response to the liquid in the tank reaching the predetermined level to act on said release means to move said release means in the one direction to cause movement of said valve to its closed position, and second responsive means responsive to said second diaphragm moving in response to the pressure in the tank exceeding the predetermined pressure to act on said release means to move said release means in the one direction to cause movement of said valve to its closed position, said second responsive means being separate from said first responsive means.

* * * * *